US006038745A

United States Patent [19]

Rapp

[11] Patent Number: 6,038,745

[45] Date of Patent: Mar. 21, 2000

[54] ADJUSTABLE STRAP

[76] Inventor: Donita M. Rapp, 1009 Country Club Dr., Petaluma, Calif. 94952

[21] Appl. No.: 09/324,690

[22] Filed: Jun. 2, 1999

Related U.S. Application Data

[60] Provisional application No. 60/092,787, Jul. 14, 1998.

[51] Int. Cl.[7] ..... A44B 21/00

[52] U.S. Cl. ..... 24/68 R; 24/302; 24/165; 24/298; 24/300; 24/265 AL

[58] Field of Search ..... 24/68 R, 68 CD, 24/298, 300–302, 265 AL, 265 CD, 265 H, 265 BC, 164, 199, 198, 200

[56] References Cited

U.S. PATENT DOCUMENTS

| | | | |
|---|---|---|---|
| 477,079 | 6/1892 | Stoddard | 24/302 X |
| 699,513 | 5/1902 | Garms | 24/302 X |
| 881,462 | 3/1908 | Craig | 24/265 AL X |
| 2,002,946 | 5/1935 | Jacobs | 24/165 X |
| 2,103,244 | 12/1937 | Briscoe | 24/302 X |
| 3,672,004 | 6/1972 | Smith | 24/302 |
| 4,155,636 | 5/1979 | Reeberg | 24/302 X |
| 4,885,824 | 12/1989 | Schawb et al. | 24/17 B |
| 5,425,485 | 6/1995 | Carlo | 24/298 X |

*Primary Examiner*—Anthony Knight
*Assistant Examiner*—Robert J. Sandy
*Attorney, Agent, or Firm*—Jack Lo

[57] ABSTRACT

An adjustable strap is comprised of an elastic band generally folded in half with one section slightly longer than the other. The end of longer section is folded back over the shorter section and stitched to the end of the shorter section and an adjacent portion of the longer section. An elongated small loop and an elongated large loop are formed on opposite sides of the stitching. A D-ring is connected to the small loop, and a clip hook is hinged to the D-ring for clipping to a supporting structure. The lateral sections of the large loop are both threaded through at least two slots in a buckle, which is slidable along the large loop to divide it into two variable-size storage loops for strapping and holding items. The buckle is slidable for changing the sizes of the storage loops for tightening around the items. A triangular ring is connected to the storage loop farther away from the clip hook. The strap may be wrapped around a supporting structure by clipping the triangular ring to the clip hook. In a second embodiment, additional buckles are movably arranged along the large loop to define additional storage loops, and a second D ring and clip hook are connected to the storage loop farthest from the first clip hook.

6 Claims, 3 Drawing Sheets

ADJUSTABLE STRAP

CROSS REFERENCE TO RELATED APPLICATIONS

The benefit of provisional application Ser. No. 60/092,787, filed Jul. 14, 1998, is claimed.

BACKGROUND OF THE INVENTION

1. Field of the Invention

This invention relates generally to adjustable straps.

2. Prior Art

A backpack, luggage, carrying case, or other shoulder-carried item is usually provided with an adjustable carrying strap. The strap is comprised of an elongated band with a fixed end fixedly attached to an anchoring ring on one end of the item, and an adjustable end threaded through another anchoring ring on the other end of the item. The adjustable end of the band is fixedly attached to a buckle which is slidable along the section of the band between the anchoring rings. I.e., the adjustable end of the band is movable relative to the fixed end for adjusting the length of the band between the anchoring rings. Such a strap cannot be detached from the item for strapping around other things. Even if it is detached, it can only be strapped around one thing. It cannot be hooked or somehow connected to a supporting structure. Also, the stitching that holds the adjustable end to the buckle may fail under stress.

OBJECTS OF THE INVENTION

Accordingly, objects of the present adjustable strap are:

to hold one or more items;

to connect the items to a supporting structure, such as a belt, backpack, purse, luggage, etc.;

to be stable when connected to the supporting structure; and to be durable.

Further objects of the present invention will become apparent from a consideration of the drawings and ensuing description.

BRIEF SUMMARY OF THE INVENTION

An adjustable strap is comprised of an elastic band generally folded in half with one section slightly longer than the other. The end of longer section is folded back over the shorter section and stitched to the end of the shorter section and an adjacent portion of the longer section. An elongated small loop and an elongated large loop are formed on opposite sides of the stitching. A D-ring is connected to the small loop, and a clip hook is hinged to the D-ring for clipping to a supporting structure. The lateral sections of the large loop are both threaded through at least two slots in a buckle, which is slidable along the large loop to divide it into two variable-size storage loops for strapping and holding items. The buckle is slidable for changing the sizes of the storage loops for tightening around the items. A triangular ring is connected to the storage loop farther away from the clip hook. The strap may be wrapped around a supporting structure by clipping the triangular ring to the clip hook. In a second embodiment, additional buckles are movably arranged along the large loop to define additional storage loops, and a second D ring and clip hook are connected to the storage loop farthest from the first clip hook.

Figure 1:
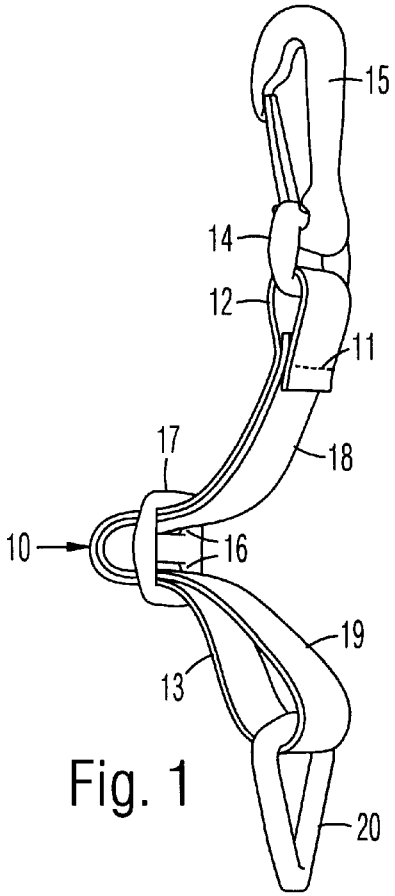
FIG. 1 is a side perspective view of the present adjustable strap.

| DRAWINGS REFERENCE NUMERALS | |
|---|---|
| 10. | Elastic Band |
| 11. | Stitching |
| 12. | Small Loop |
| 13. | Large Loop |
| 14. | D-Ring |
| 15. | Clip Hook |
| 16. | Slots |
| 17. | Buckle |
| 18. | Storage Loop |
| 19. | Storage Loop |
| 20. | Triangular Ring |
| 21. | Item Being Carried |
| 22. | Supporting Structure |
| 23. | Supporting Structure |
| 30. | Elastic Band |
| 31. | Stitching |
| 32. | Small Loop |
| 33. | Large Loop |
| 34. | D-Ring |
| 35. | Clip Hook |
| 36. | D-Ring |
| 37. | Clip Hook |
| 38. | Slots |
| 39. | Buckle |
| 40. | Buckle |
| 41. | Buckle |
| 42. | Storgae Loop |
| 43. | Storage Loop |
| 44. | Storage Loop |
| 45. | Storage Loop |
| 46. | Triangular Ring |
| 47. | Item Being Carried |
| 48. | Item Being Carried |
| 49. | Supporting Structure |

DETAILED DESCRIPTION OF THE INVENTION

A first embodiment of an adjustable strap is shown in a side perspective view in FIG. 1. It is comprised of an elastic band 10 folded generally in half. The end of a slightly longer section is folded back over an end of a shorter section, and fixed to the end of the shorter section and an adjacent portion of the longer section with stitching 11, which is preferably a type of stitching known as bartack. An elongated small loop 12 and an elongated large loop 13 are defined on opposite sides of stitching 11. A D-ring 14 is connected to small loop 12, and a proximal end of a clip hook 15 is hinged to D-ring 14.

Large loop 13 is comprised of a pair of lateral sections which are both threaded completely through two slots 16 on a slidable buckle 17. Large loop 13 is divided by buckle 17 into first and second variable-size storage loops 18 and 19, the sizes of which may be varied by sliding buckle 17. A triangular ring 20 is connected to storage loop 19, i.e., the loop farthest from clip hook 15. Buckle 17 is prevented from sliding off the end of large loop 13 by triangular ring 20.

Figure 2:
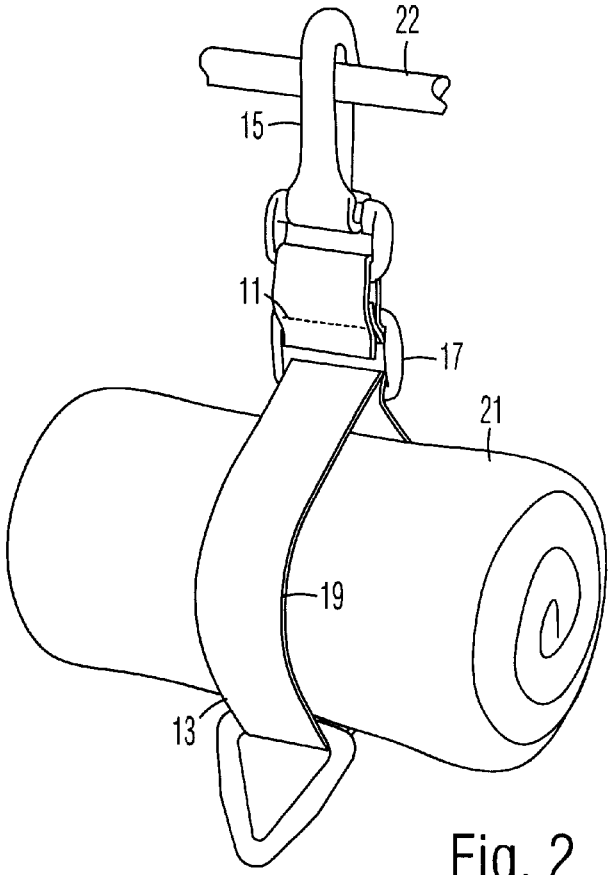
FIG. 2 is a front perspective view of the strap holding an item and clipped to a supporting structure.

The strap is suitable for holding a variety of items, such as rolled-up clothing, water bottles, soda cans, etc. In FIG. 2, an item 21 is carried in storage loop 19. Buckle 17 is slid toward clip hook 15 until storage loop 19 is large enough to slip around item 21. Buckle 17 is slid back toward item 21 to tighten storage loop 19 around it. Although item 21 is large enough to require buckle 17 to be slid all the way toward clip hook 15, buckle 17 may be slid toward the middle of large loop 13 for carrying two smaller items. Strain on stitching 11 is relieved by buckle 17 for increased durability. Clip hook 15 is clipped around a suitable supporting structure 22, which may be a bar, D-ring, belt, belt loop, purse, luggage, backpack, etc.

The strap may be wrapped around a supporting structure 23 for greater stability. Triangular ring 20 is connected to clip hook 15 to prevent item 21 from swinging around. It may also be necessary to wrap the strap around a supporting structure when the supporting structure is not thin enough for clip hook 15 to clip onto. Triangular ring 20 is shaped to ensure that it is centered about clip hook 15 and distribute stress evenly on band 10.

Figure 4:
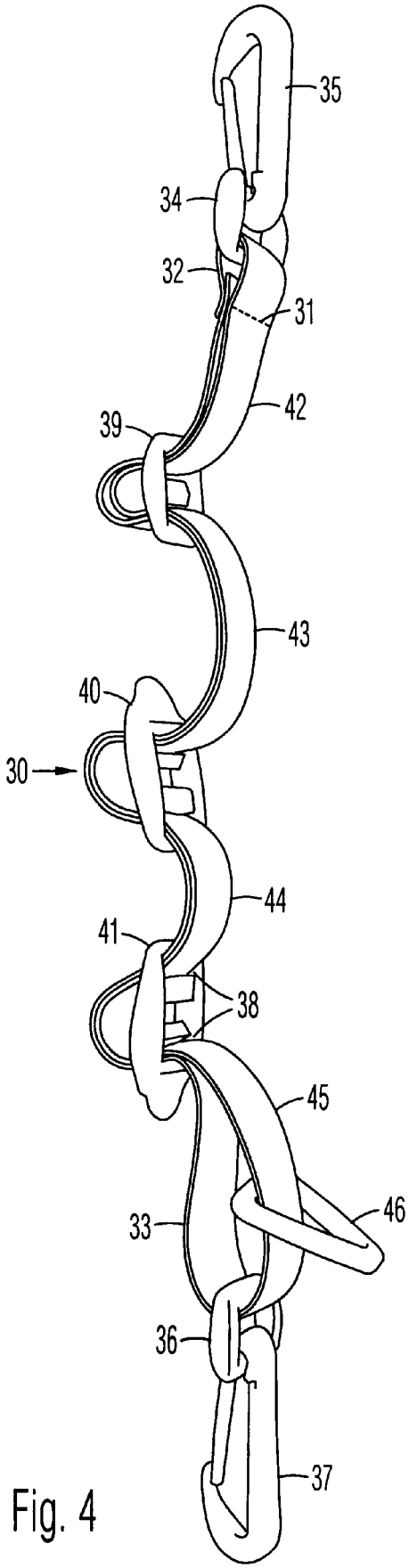
FIG. 4 is a side perspective view of a second embodiment of the strap.

A second embodiment of the adjustable strap is shown in a side perspective view in FIG. 4. It is comprised of an elastic band 30, which is preferably elastic, folded generally in half. The end of a slightly longer section is folded back over an end of a shorter section, and fixed to the end of the shorter section and an adjacent portion of the longer section with stitching 31. An elongated small loop 32 and an elongated large loop 33 are defined on opposite sides of stitching 31. A D-ring 34 is connected to small loop 32, and a proximal end of a clip hook 35 is hinged to D-ring 34. A D-ring 36 is connected to the distal portion of large loop 33, and a proximal end of a clip hook 37 is hinged to D-ring 36.

Large loop 33 is comprised of a pair of lateral sections which are both threaded completely through at least two slots 38 in each of a plurality of slidable buckles 39–41. Large loop 33 is divided by buckles 39–41 into first-fourth variable-size storage loops 42–45, the sizes of which may be varied by sliding buckles 39–41. A triangular ring 46 is connected to storage loop 45, i.e., the loop farthest from clip hook 35. Buckle 41 is prevented from sliding off the end of large loop 33 by triangular ring 46 and D-ring 36.

Figure 3:
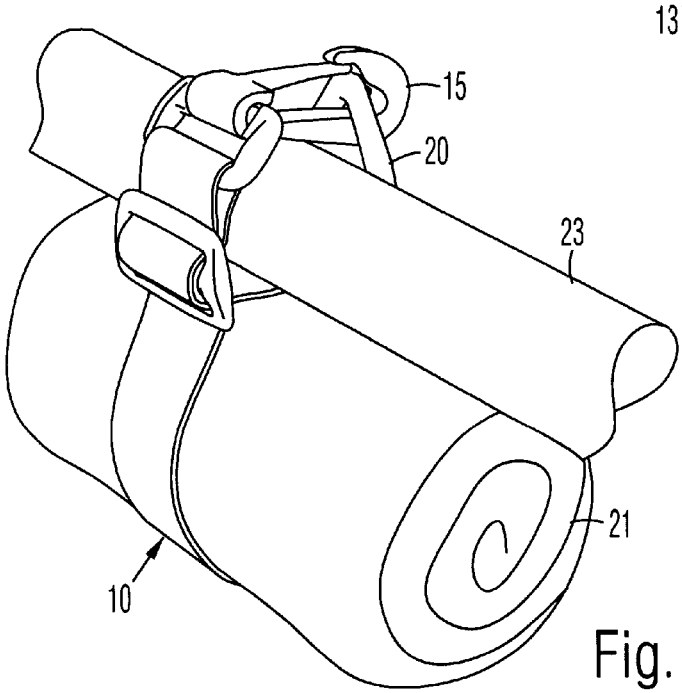
FIG. 3 is a side perspective view of the strap holding an item and wrapped around a supporting structure.
Figure 5:
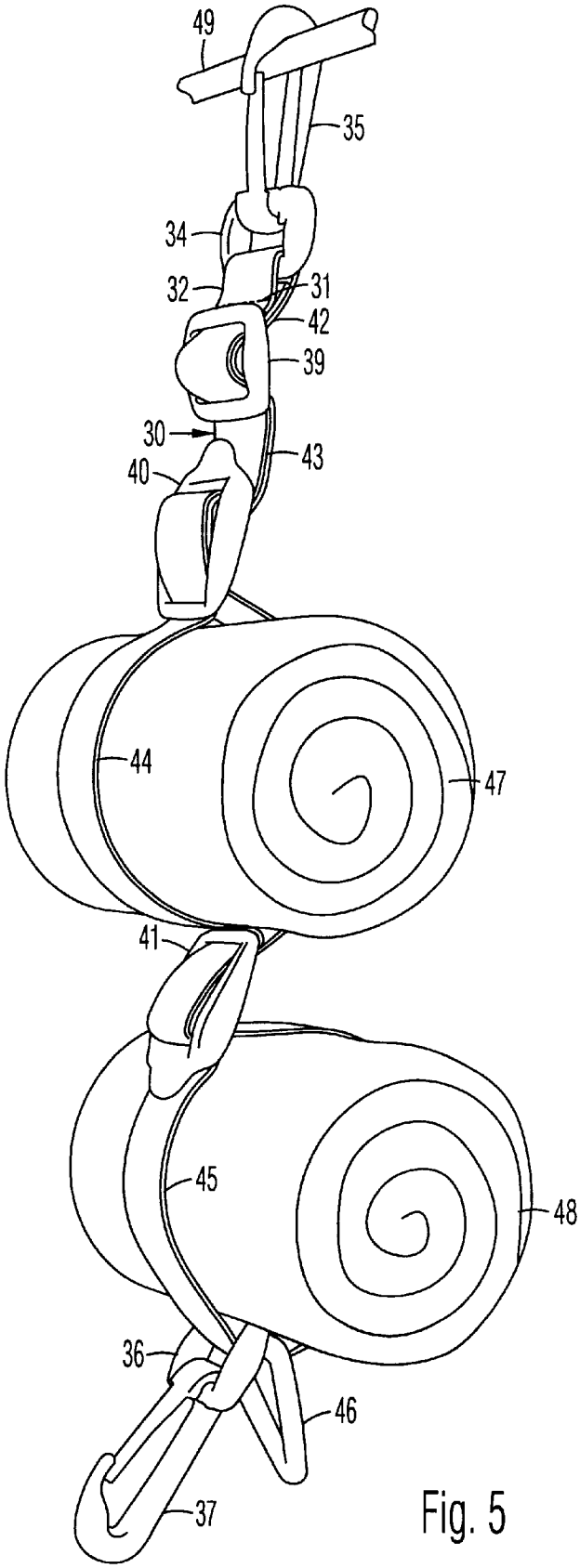
FIG. 5 is a side perspective view of the strap of FIG. 4 holding a plurality of items and clipped to a supporting structure.

In FIG. 5, two items 47 and 48 are carried in storage loops 44 and 45. Buckles 39 and 40 are slid toward clip hook 35 until storage loops 44 and 45 are large enough to slip around items 47 and 48. Buckles 40 and 39 are slid back toward items 47 and 48 to tighten storage loops 44 and 45 around them. Although items 47 and 48 are large enough to require buckles 40 and 41 to be slid all the way toward clip hook 35, buckles 39–41 may be adjusted for carrying up to four smaller items, or one larger item. Strain on stitching 31 is relieved by buckle 39. Clip hook 35 is clipped around a supporting structure 49, which may be a bar, D-ring, belt loop, purse, luggage, backpack, etc. Clip hook 37 may also be connected to the supporting structure. For stability or attachment to a large supporting structure, the strap may be wrapped around the supporting structure, and triangular ring 46 or clip hook 37 may be connected to clip hook 35 in a way similar to that shown in FIG. 3.

SUMMARY AND SCOPE

Accordingly, the present adjustable strap holds one or more items. It connects the items to a supporting structure, such as a belt loop, backpack, purse, luggage, etc. It is stable when connected to the supporting structure. It is also durable.

Although the above description is specific, it should not be considered as a limitation on the scope of the invention, but only as an example of the preferred embodiment. Many variations are possible within the teachings of the invention. For example, the bands may be of any suitable dimensions. A different number of buckles may be provided. Therefore, the scope of the invention should be determined by the appended claims and their legal equivalents, not by the examples given.

I claim:

1. An adjustable strap, comprising:

an elastic band generally folded in half and having opposite ends attached together forming an elongated loop with a pair of lateral sections;

a clip hook connected to said loop for clipping to a supporting structure;

a buckle with at least two slots, both of said lateral sections of said loop being threaded through both of said slots in said buckle, said buckle being slidable along said loop to divide said loop into two variable-size storage loops for strapping and holding items, said buckle is slidable along said elongated loop to change the sizes of said storage loops for tightening around said items; and a triangular ring connected to said elongated loop on a side of said buckle opposite said clip hook, said strap for wrapping around said supporting structure by clipping said clip hook to said triangular ring, said triangular ring centering said clip hook on itself and distributing stress evenly on said loop.

2. The adjustable strap of claim 1, further including a D-ring connected between said clip hook and said elongated loop, said clip hook being pivoted to said D-ring.

3. An adjustable strap, comprising:

an elastic band generally folded in half with a longer section and a shorter section, an end of said longer section folded back over itself and overlapping a corresponding end of said shorter section, said end of said longer section attached with stitching to said end of said shorter section and an adjacent portion of said longer section, thus forming an elongated small loop and an elongated large loop on opposite sides of said stitching, said large loop including a pair of lateral sections;

a clip hook connected to said small loop for clipping to a supporting structure;

a buckle with at least two slots, both of said lateral sections of said large loop being threaded through both of said slots in said buckle, said buckle being slidable along said large loop to divide said large loop into two variable-size storage loops for strapping and holding items, said buckle is slidable along said large loop to change the sizes of said storage loops for tightening around said items; and a triangular ring connected to said large loop on a side of said buckle opposite said clip hook, said strap for wrapping around said supporting structure by clipping said clip hook to said triangular ring, said triangular ring centering said clip hook on itself and distributing stress evenly on said loop.

4. The adjustable strap of claim 3, further including a D-ring connected between said clip hook and said small loop, said clip hook being pivoted to said D-ring.

5. An adjustable strap, comprising:

an elastic band generally folded in half with a longer section and a shorter section, an end of said longer section folded back over itself and overlapping a corresponding end of said shorter section, said end of said longer section attached with stitching to said end of said shorter section and an adjacent portion of said longer section, thus forming an elongated small loop and an elongated large loop on opposite sides of said stitching, said large loop including a pair of lateral sections;

a first clip hook connected to said small loop;

a second clip hook connected to said large loop;

a plurality of buckles each with at least two slots, said lateral sections of said large loop being threaded through both of said slots in each of said buckles, said buckles being slidable along said large loop to divide said large loop into a plurality of variable-size storage loops for strapping and holding items, said buckles being slidable along said large loop to change the sizes of said storage loops for tightening around said items; and a triangular ring connected to said large loop, said strap for wrapping around said supporting structure by clipping said clip hook to said triangular ring, said triangular ring centering said clip hook on itself and distributing stress evenly on said loop.

6. The adjustable strap of claim 5, further including a first D-ring connected between said first clip hook and said small loop, and a second D-ring connected between said second clip hook and said large loop.

* * * * *